US008818696B2

(12) United States Patent
Klooster et al.

(10) Patent No.: US 8,818,696 B2
(45) Date of Patent: Aug. 26, 2014

(54) METHOD AND SYSTEM FOR AERIAL VEHICLE TRAJECTORY MANAGEMENT

(75) Inventors: Joel Kenneth Klooster, Grand Rapids, MI (US); Liling Ren, Rexford, NY (US); Joachim Karl Ulf Hochwarth, Grand Rapids, MI (US)

(73) Assignee: GE Aviation Systems LLC, Grand Rapids, MI (US)

( * ) Notice: Subject to any disclaimer, the term of this patent is extended or adjusted under 35 U.S.C. 154(b) by 103 days.

(21) Appl. No.: 13/069,866

(22) Filed: Mar. 23, 2011

(65) Prior Publication Data

US 2012/0245834 A1 Sep. 27, 2012

(51) Int. Cl.
*G08G 5/00* (2006.01)

(52) U.S. Cl.
CPC ..... *G08G 5/0034* (2013.01); *G08G 5/0039* (2013.01)
USPC ..... 701/120; 342/29; 701/528

(58) Field of Classification Search
USPC ..... 701/120
See application file for complete search history.

(56) References Cited

U.S. PATENT DOCUMENTS

| | | | | |
|---|---|---|---|---|
| 6,134,500 | A * | 10/2000 | Tang et al. | 701/528 |
| 6,266,610 | B1 * | 7/2001 | Schultz et al. | 701/528 |
| 6,314,362 | B1 * | 11/2001 | Erzberger et al. | 701/120 |
| 7,363,152 | B2 | 4/2008 | Sjanic | |
| 7,499,771 | B2 * | 3/2009 | Caillaud | 701/3 |
| 7,612,716 | B2 * | 11/2009 | Smith et al. | 342/454 |
| 7,650,232 | B1 * | 1/2010 | Paielli | 701/528 |
| 7,664,596 | B2 | 2/2010 | Wise et al. | |
| 7,707,145 | B2 | 4/2010 | Mischke | |
| 7,734,386 | B2 * | 6/2010 | DelNero et al. | 701/23 |
| 7,734,411 | B2 * | 6/2010 | Gremmert | 701/528 |
| 7,774,131 | B2 * | 8/2010 | Deker | 701/528 |
| 7,835,825 | B2 * | 11/2010 | Coulmeau et al. | 701/3 |
| 7,877,197 | B2 | 1/2011 | Lewis et al. | |
| 8,234,068 | B1 * | 7/2012 | Young et al. | 701/528 |

(Continued)

FOREIGN PATENT DOCUMENTS

| | | | |
|---|---|---|---|
| EP | 1995706 | A2 | 11/2008 |
| GB | 2430278 | A | 3/2007 |
| GB | 2440249 | A | 1/2008 |
| WO | 02/099769 | A1 | 12/2002 |

OTHER PUBLICATIONS

Klooster, Joel and Torres, Sergio et al. Trajectory Synchornization and Negotiation in Trajectory Based Operations, 29th Digital Avionics Systems Conference (Oct. 3-7, 2010).*

(Continued)

*Primary Examiner* — John R Olszewski
*Assistant Examiner* — Jean-Paul Cass
(74) *Attorney, Agent, or Firm* — William Scott Andes, Esq.; Armstrong Teasdale LLP

(57) ABSTRACT

A method and system of managing an aerial vehicle trajectory is provided. The remote trajectory management system (RTMS) for a fleet of aircraft includes an input specification module configured to manage information specifying flight-specific input data used to generate a trajectory, an aircraft model module including data that specifies a performance of the aircraft and engines of the aircraft, a predict 4D trajectory module configured to receive the specified inputs from the input specification module and an aircraft performance model from aircraft model module and to generate a 4D trajectory for a predetermined flight, and a trajectory export module configured to transmit a predetermined subset of the predicted trajectory to the aircraft.

17 Claims, 4 Drawing Sheets

(56) References Cited

U.S. PATENT DOCUMENTS

| | | | | |
|---|---|---|---|---|
| 2007/0208465 | A1* | 9/2007 | Gremmert | 701/4 |
| 2007/0222665 | A1* | 9/2007 | Koeneman | 342/29 |
| 2008/0004792 | A1 | 1/2008 | Wise et al. | |
| 2008/0172172 | A1 | 7/2008 | Ng | |
| 2009/0037091 | A1 | 2/2009 | Bolt, Jr. et al. | |
| 2009/0112645 | A1 | 4/2009 | Jha et al. | |
| 2009/0125221 | A1 | 5/2009 | Estkowski et al. | |
| 2009/0150012 | A1 | 6/2009 | Agam et al. | |
| 2010/0131402 | A1 | 5/2010 | Davies | |
| 2010/0282916 | A1 | 11/2010 | Garrido-Lopez et al. | |
| 2012/0116614 | A1* | 5/2012 | Torres et al. | 701/3 |

OTHER PUBLICATIONS

Search Report and Written Opinion from EP Application No. 12160890.5, dated Sep. 5, 2012.

* cited by examiner

METHOD AND SYSTEM FOR AERIAL VEHICLE TRAJECTORY MANAGEMENT

BACKGROUND OF THE INVENTION

The field of the invention relates generally to air traffic management and aircraft operator fleet management, and more specifically, to a method and system for collaborative planning and negotiating trajectories amongst stakeholders.

Facing increased levels of air traffic combined with a need to support more efficient operations, increased collaboration between aircraft operators and Air Navigation Service Providers (ANSPs) is needed. Currently, operators provide only basic data such as departure and arrival airports and schedule in the days and hours before a flight. While this allows very crude planning of demand for airspace and runways, it is limited in the amount of detail it can provide for both ANSPs and operators to allocate resources. A more detailed flight plan with information such as cruising altitude, speed and the enroute airways that the flight would prefer to take are not provided until shortly (typically less than 1 hour) before departure. Some aircraft (and in the planned future Air Traffic Management (ATM) system most aircraft) can down link a full detailed 4D Trajectory from their Flight Management System (FMS) to air traffic control (ATC). However, this cannot be done until all the necessary parameters (including weights) are entered in the FMS, which does not typically happen until just before departure. Because a detailed description of the 4D trajectory is not available early in the planning process, adjustments to the aircraft's flight must be more tactical and reactionary, significantly reducing the efficiency of the flight.

Prior attempts to solve this problem involve sharing the flight plan between the operator and the ANSP. However, the flight plan does not include the full trajectory, and includes only named points and a single cruise altitude and speed. The lack of the full trajectory and intent information that is provided in this system limits the type of planning and therefore the efficiency that can be achieved. At least some known methods involve only the computation of the flight plan route itself and do not include the generation of a trajectory based on the flight plan and communication of this trajectory and intent information to the ANSP from an aircraft operator and do not provide a flexible method of specifying the output or distribution of that trajectory to an ANSP.

BRIEF DESCRIPTION OF THE INVENTION

In one embodiment, a Remote Trajectory Management System (RTMS) for a fleet of aircraft includes an input specification module configured to manage information specifying flight-specific input data used to generate a trajectory, an aircraft performance model module including data that specifies a performance of the airframe and engines of the aircraft, a predict 4D trajectory module configured to receive the specified inputs from the input specification module and an integrated aircraft and engine model module from aircraft model module and to generate a 4D trajectory for a predetermined flight, and a trajectory export module configured to transmit a predetermined subset of the predicted trajectory parameters via an interface to at least one of the aerial vehicle, the operator entity of the aerial vehicle, and an airspace control entity.

In another embodiment, a method of managing an aerial vehicle trajectory includes receiving by an RTMS business information relating to the operation of the aerial vehicle from an operator entity of the aerial vehicle, receiving by the RTMS information relating to airspace constraints along a predetermined route of the aerial vehicle from an airspace control entity, negotiating by the RTMS between the operator entity and the control entity a 4D trajectory for the aerial vehicle, and transmitting by the RTMS one or more changes to that trajectory including at least one of new waypoints and a cruise level change that facilitate the aerial vehicle complying with the negotiated trajectory to the aerial vehicle.

In yet another embodiment, a Fleet Wide Trajectory Management System (FWTMS) includes a plurality of RTMS's that each include an input specification module configured to manage information specifying flight-specific input data used to generate a trajectory, an aircraft model module including data that specifies a performance of the airframe and engines of the aircraft, a predict 4D trajectory module configured to receive the specified inputs from the input specification module and an aircraft performance model from the aircraft model module and to generate a 4D trajectory for a predetermined flight, and a trajectory export module configured to transmit a predetermined subset of the predicted trajectory parameters via an interface to at least one of the aerial vehicle, the operator entity of the aerial vehicle, and an airspace control entity, where the FWTMS is communicatively coupled to an air navigation service provider to negotiate trajectories for a plurality of aerial vehicles operated by a business entity, wherein the business entity is configured to propose trajectories for the plurality of aerial vehicles based on business objectives and airspace condition (including airspace structure, weather, and traffic condition) parameters and receive modifications to the proposed trajectories from the air navigation service provider based on airspace restrictions and regulations of the air navigation service provider.

BRIEF DESCRIPTION OF THE DRAWINGS

FIG. 1 is a data flow diagram of a trajectory-intent generation system 100 in accordance with an exemplary embodiment of the present invention;

FIG. 2 is a data flow diagram of a trajectory dissemination and evaluation system in accordance with an exemplary embodiment of the present invention;

FIG. 3 is a data flow diagram for a Fleet Wide Trajectory Management System (FWTMS) in accordance with an exemplary embodiment of the present invention.

DETAILED DESCRIPTION OF THE INVENTION

The following detailed description illustrates embodiments of the invention by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure. The disclosure is described as applied to an exemplary embodiment, namely, systems and methods of managing aerial vehicle 4D trajectories. However, it is contemplated that this disclosure has general application to vehicle management systems in industrial, commercial, and residential applications.

As used herein, an element or step recited in the singular and preceded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Embodiments of the present invention describes a method and system for computing a 4-Dimensional (latitude, longitude, altitude and time) trajectory or a position in any three-dimensional (3D) space and time, where the 3D space may be described by Cartesian coordinates or non-Cartesian coordinates such as the position of a train in a rail network, and aircraft intent data (such as speeds, thrust settings, and turn radius) at a flight operations center. This trajectory-intent data may be generated using the same methods as an aircraft-based flight management system (FMS). The trajectory-intent data is formatted to the specified output format, for example, but not limited to Extensible Markup Language (XML), and distributed to authorized stakeholders, such as airline dispatchers, air traffic controllers or traffic flow managers. This allows the information content to be tailored to the type and granularity needed by the various stakeholders, while hiding information that the flight operator does not want distributed (such as gross weight or cost index). By using the same information as is provided to the aircraft's FMS, the trajectory-intent information is more reliable and accurate than other methods. This is also useful for planning of the trajectory a flight well in advance of the flight's departure, even days or months beforehand, with modeled airspace conditions.

Figure 1:
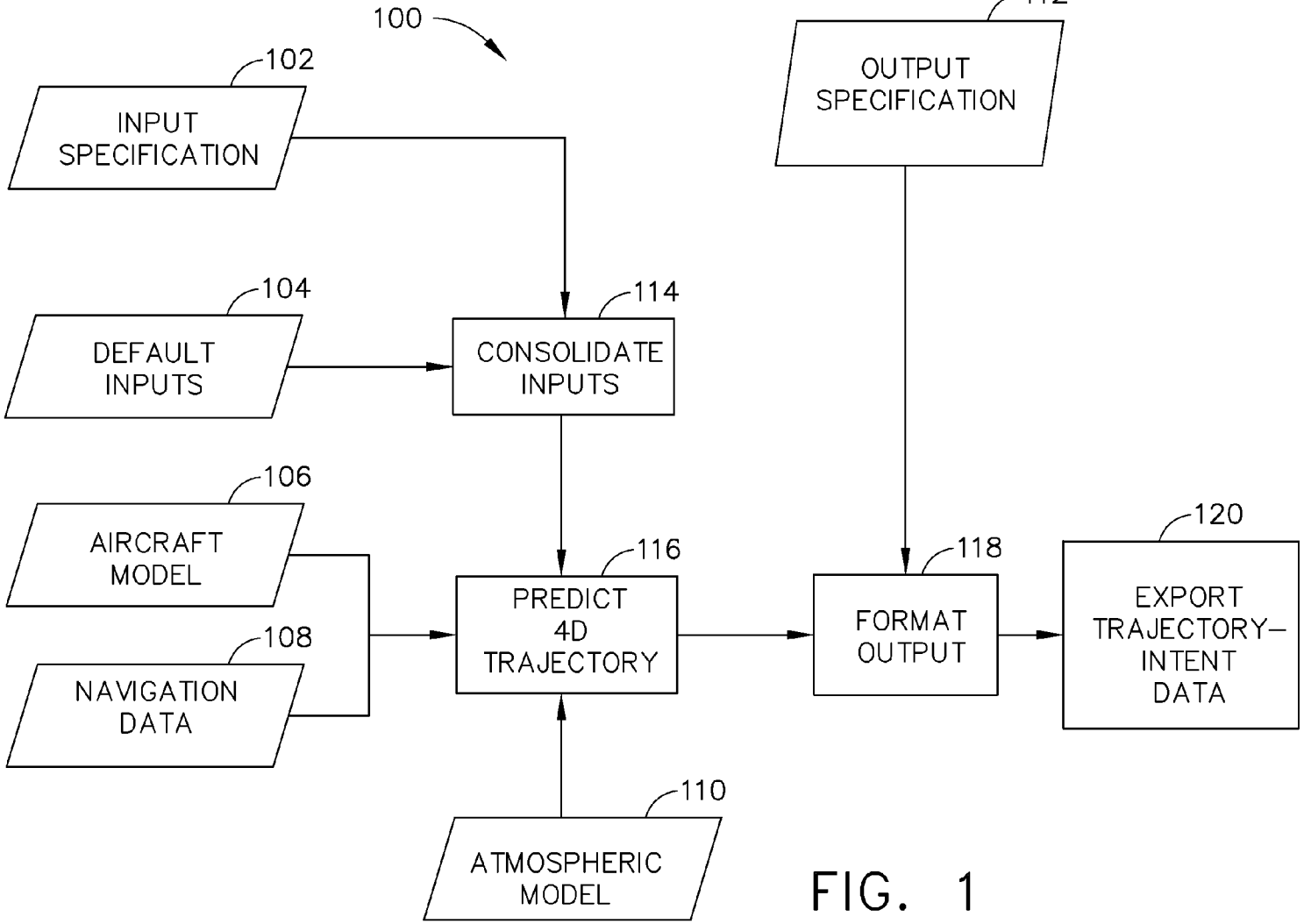
FIGS. 1-3 show exemplary embodiments of the method and system described herein.

FIG. 1 is a data flow diagram of a trajectory-intent generation system 100 in accordance with an exemplary embodiment of the present invention. In the exemplary embodiment, trajectory-intent generation system 100 is configured to generate and export trajectory-intent data. Trajectory data describes the position of an aircraft or other aerial vehicle in 4-dimensions for all positions of the aircraft between takeoff and landing. The intent data describes how the aircraft or other aerial vehicle will be flying along the trajectory. Trajectory-intent generation system 100 includes an input specification module 102 that includes information specifying flight-specific input data used to generate the trajectory. The input specification information includes, for example, but not limited to, aircraft type (for example, Boeing 737-700 with Winglets and engines with 24 klbs thrust rating), Zero-Fuel Weight, Fuel, Cruise Altitude, Cost Index, and lateral route (such as a city-pair or airline preferred company route) and terminal procedures such as departure, arrival, and approach procedures. In the exemplary embodiment, the input specification information is specific to a particular aircraft, which may be specified by a tail number, registration identifier, or other identifier of a particular aircraft. Aircraft aerodynamics and aircraft component (including engines) performance may change over time. The input specification information captures such changes and permits trajectory-intent generation system 100 to account for those differences in predicting the 4D trajectory. The input specification information is stored for example, in a file, database, or data structure (using a programming language such as MATLAB or C++) and may be generated by a front-end graphical user interface.

Trajectory-intent generation system 100 also includes a default input module 104. The default input information includes default values for inputs that are not included in input specification module 102. For example, in the weeks before a flight the exact aircraft type, gross weight and cost index may not be decided yet as they are parameters that are very dependant on weather and passenger count, which is likely not known well enough until right before flight. The aerial vehicle operator may specify default values for these parameters if they are not yet specified. A plurality of default value combinations may be provided by the default input model 104 to capture various operational scenarios such as maximum takeoff, or ferry flight scenarios.

An aircraft model module 106 includes data that specifies the performance of the aircraft and engines. It is used by trajectory-intent generation system 100 to compute the speeds, thrust, drag, fuel-flow, and other characteristics of the aircraft needed to predict the 4-dimensional trajectory. In one embodiment, a publicly available performance model such as Eurocontrol's Base of Aircraft Data (BADA) may be used. Alternatively, the trajectory predictor may use the aircraft and engine manufacturers proprietary performance model, for example, an FMS-loadable Model-Engine Database or the performance engineering data (provided in tabular format or embedded in flight performance tools). Further, the trajectory predictor may use the flight performance data in the Flight Crew Operations Manual which provides takeoff, climb, cruise, descent, approach operational performance data but not aircraft aerodynamic data and engine performance data.

A navigation data module 108 specifies the information needed to translate the flight plan into a series of latitudes, longitudes, altitudes and speeds used by trajectory-intent generation system 100 to generate a trajectory. In the exemplary embodiment, navigation data module 108 includes the same navigation database that is loaded into the aircraft's flight management system. In various embodiments, other navigation databases are used in navigation data module 108.

An atmospheric model module 110 includes data that describes the atmospheric conditions for the flight, such as the standard atmospheric model and specific weather conditions including winds and temperatures aloft and air pressure. The specific weather data may be as simple as the average wind. Alternatively, it may be a gridded data file with conditions specified at various latitudes, longitudes, altitudes and times (such as the Rapid Update Cycle [RUC] data provided by the National Oceanic and Atmospheric Association [NOAA]). Since this information may not be well known long before the flight, this may also be historical statistical data such as mean winds, or categorical data such as hot summer day from which a more detailed model may be derived.

An output specification module 112 specifies the content and formatting for the output of the trajectory-intent data. Providing a flexible output format and content allows only the information necessary for the intended user to be provided. This allows parameters such as weight and cost index, which may be considered proprietary or competitively sensitive to the airline, to be hidden from users for which it is not needed. This also allows the content of the data to be tailored for its use. Long before the flight only a small amount of data related to the flight may be useful. This allows a reduction of the file size to only that necessary, thereby reducing communication costs.

Trajectory-intent generation system 100 also includes a consolidate inputs module 114, which is used to combine the specified inputs from input specification module 102 and default inputs from default input module 104 into a consistent set of data. In various embodiments, consolidate inputs module 114 also performs a reasonableness check to ensure that specified inputs are within realistic bounds.

A predict 4D trajectory module 116 processes the specified inputs from input specification module 102, default inputs from default input module 104, aircraft performance model from aircraft model module 106, navigation data from navigation data module 108, and weather information from atmospheric model module 110 to generate a 4D trajectory for the specified flight. In various embodiments, predict 4D trajectory module 116 may be embodied in a Flight Management System Trajectory Predictor, which would allow the full specification of flight inputs as is available on the aircraft itself.

A format output module 118 processes the trajectory and intent data and converts it into the format specified in output specification module 112. For example, this may be a file in Extensible Markup Language (XML) format, a simple ASCII text file, or a data structure in a language such at MATLAB or C++.

An export trajectory-intent module 120 distributes the trajectory-intent output from the formatting process in format output module 118. In one embodiment, export trajectory-intent module 120 writes an output file. In various embodiments, export trajectory-intent module 120 writes output to, for example, but not limited to a TCP/IP network connection. In one embodiment, a portion of the output file is transmitted to the aircraft as instructions for changing an onboard trajectory being used to operate the aircraft via wired or wireless data link.

Trajectory-intent generation system 100 permits sharing a wide range of customized trajectory and intent information for a specific flight or flights from an aircraft operator to an air navigation service provider (ANSP). The trajectory and intent information can be used to plan the demand for certain resources (such as an airspace sector or airport runway) and allocate staffing or resources by the ANSP. It can also be used as the basis for negotiating modifications to that trajectory in the form of new inputs. For example, if the proposed trajectory will violate a no-fly zone (such as a military Special Use Airspace that becomes active), this can be communicated to the aircraft operator and new inputs to generate a modified trajectory can be specified by the operator.

Figure 2:
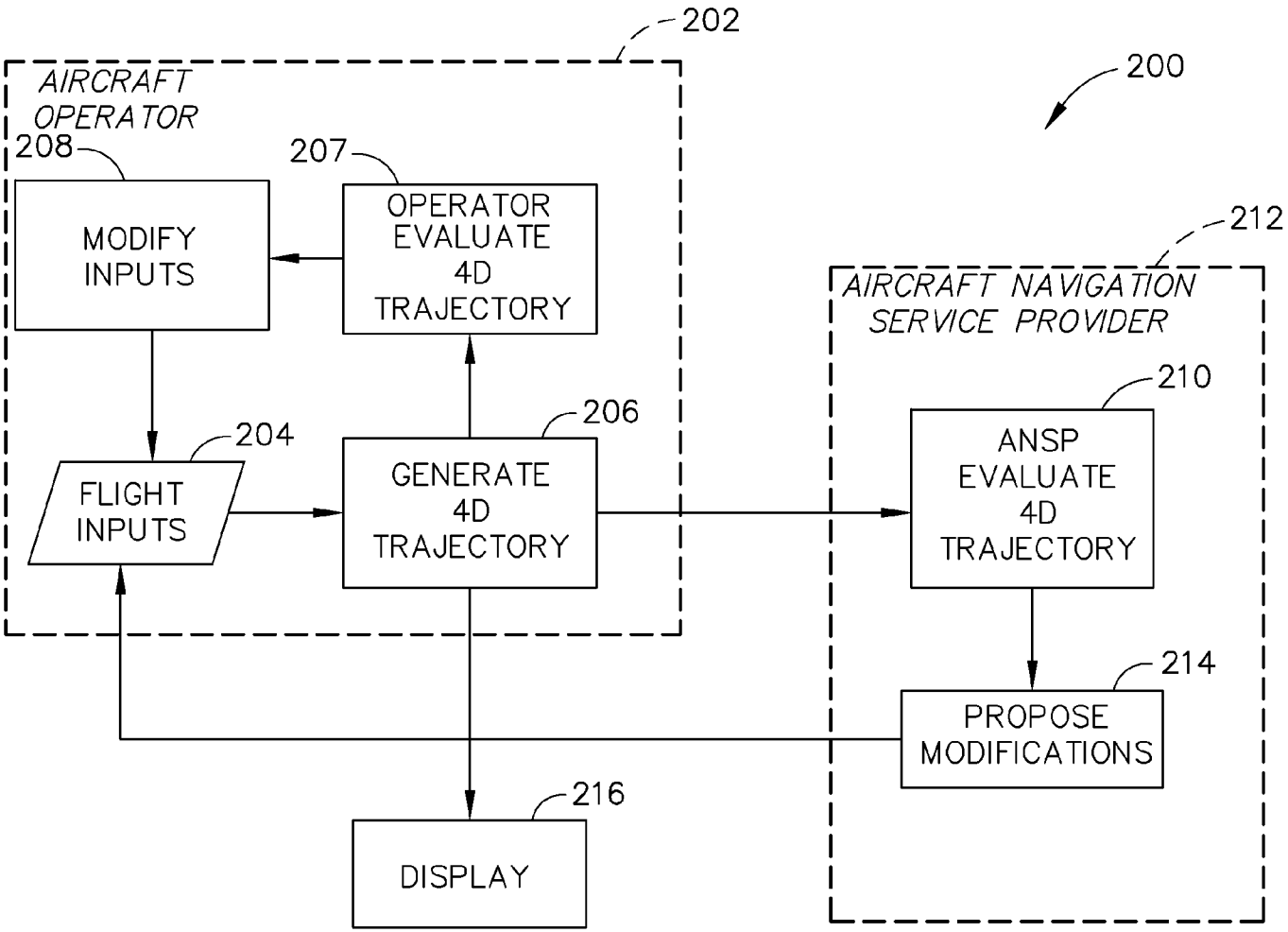

FIG. 2 is a data flow diagram of a trajectory dissemination and evaluation system 200 such as another embodiment of trajectory-intent generation system 100 (shown in FIG. 1) in accordance with an exemplary embodiment of the present invention. In the exemplary embodiment, trajectory dissemination and evaluation system 200 is also used by the aircraft operator itself to evaluate the trajectory against operator objectives, such as time and fuel used, to modify the inputs to create a new trajectory. For example, the cost index or cruise altitude may be modified if the time and fuel cost do not satisfy operator business objectives. A first portion 202 of trajectory dissemination and evaluation system 200 is used by an aircraft operator, such as, an airline company and includes a flight input module 204 configured to receive parameters for a flight that the operator wants to evaluate. The parameters are used to generate a 4D trajectory in a generate 4D trajectory module 206, such as that shown in FIG. 1. The generated 4D trajectory is output to an operator evaluate 4D trajectory module 207 of the first portion 202 of trajectory dissemination and evaluation system 200 and to an ANSP evaluate 4D trajectory module 210 of a second portion 212 of trajectory dissemination and evaluation system 200. Operator evaluate 4D trajectory module 207 evaluates the generated 4D trajectory for compliance with the aircraft operator business goals or tests against various operational scenarios. The modify inputs module 208 of first portion 202 takes the output from this evaluation and in one embodiment, automatically adjusts the flight inputs until the aircraft operator business goals are met. In various other embodiments, modify inputs module 208 suggests changes to input parameters for evaluation and acceptance by the aircraft operator. The 4D trajectory may output to a display 216 or to other systems (not shown in FIG. 2) for further processing.

ANSP evaluate 4D trajectory module 210 is configured to receive and evaluate the generated 4D trajectory for compliance with the air navigation service providers' requirements. If the generated 4D trajectory does not meet the requirements of the air navigation service provider, the air navigation service provider can propose changes to the 4D trajectory through a propose modifications module 214 of second portion 212.

Figure 3:
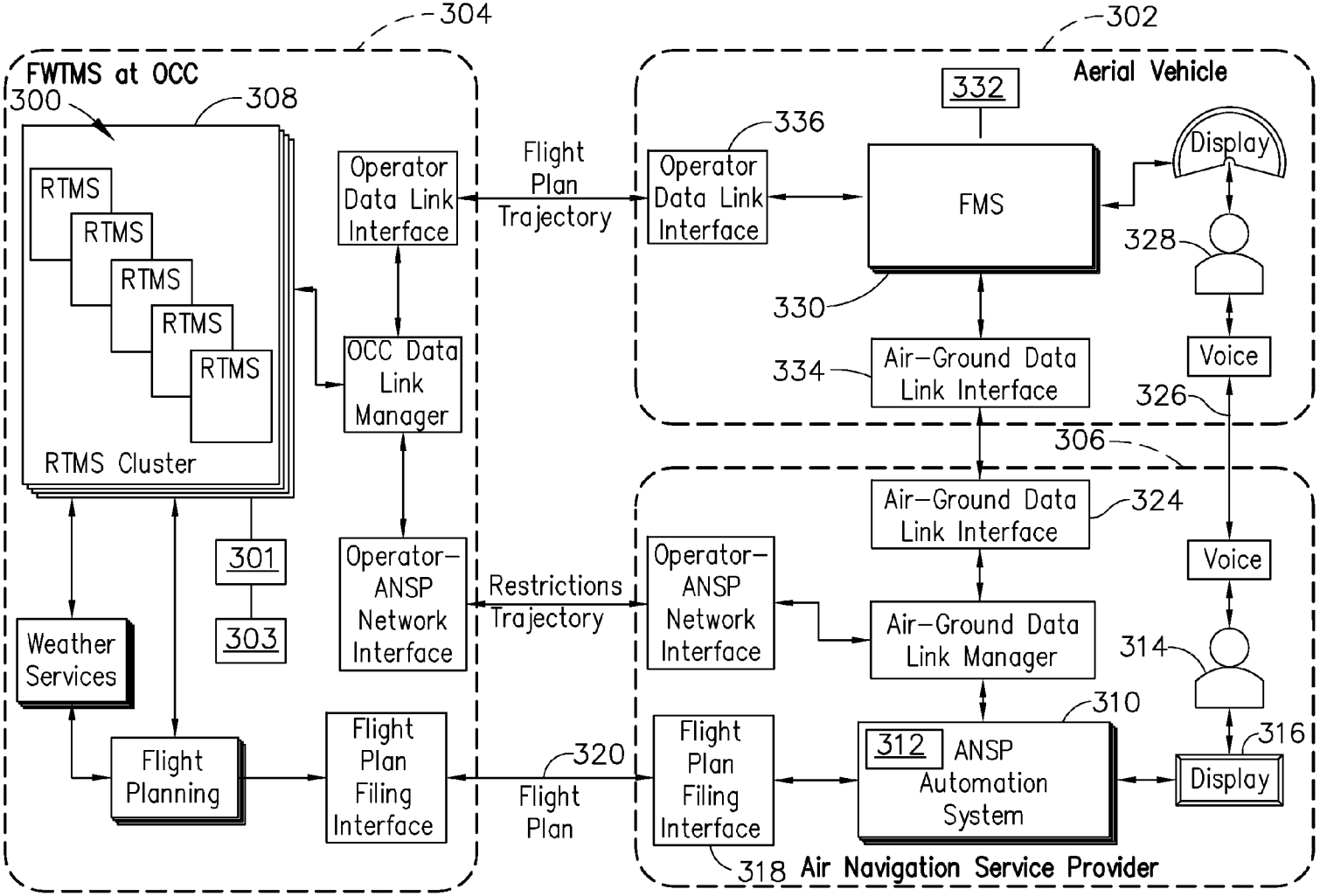

FIG. 3 is a data flow diagram for a group or cluster of Remote Trajectory Management Systems (RTMS) 300 in accordance with an exemplary embodiment of the present invention. In the exemplary embodiment, RTMS cluster 300 is a tool that may be embodied in for example, but not limited to, software, firmware, and/or hardware. In the exemplary embodiment, RTMS 300 includes a processor 301 communicatively coupled to a memory device 303 that is used to store instructions used by processor to implement RTMS 300. RTMS 300 provides a method for remotely managing the trajectory of a manned or unmanned Aerial Vehicle (UAV) 302 to plan, modify, predict, and manage an aerial vehicle's trajectory in four-dimensional (4D) airspace. In the exemplary embodiment, RTMS 300 is installed in a Fleet Wide Trajectory Management System 304 at an aerial vehicle operator's Operations Control Center (OCC) that is conveniently accessible, directly or via wired or wireless network. FWTMS 304 is positioned at a location that is safe, economical, and effective for managing the trajectory, which may either be a building structure, a ground vehicle, a sea borne vessel, another aerial vehicle, or a spacecraft.

RTMS 300 combines accurate trajectory planning and prediction capabilities in an FWTMS 304 at the OCC, incorporating information about the airspace constraints, strategic conflict resolution actions, and Traffic Flow Management (TFM) initiatives from an Air Navigation Service Provider (ANSP) 306 such as the Federal Aviation Administration (FAA) in the United States to achieve an optimal trajectory. Trajectory synchronization and negotiation between RTMS 300 and ANSP 306 are achieved without frequent costly (both in terms of monetary cost and time) wireless data link communications between aerial vehicle 302 and ANSP 306, and frequent aircrew responses in case of a manned aerial vehicle, during trajectory synchronization and negotiation. The final inputs that are sent to aerial vehicle 302, such as a change in altitude or several additional waypoints, are much more compact in size than the entire trajectory and thus significantly reduce costs for communication directly with aerial vehicle 302. The negotiated trajectory satisfies Air Traffic Control (ATC) objectives, and at the same time satisfies to a maximum the aerial vehicle operator's business preference. As a result, significant amount of fuel and flight time may be saved for the operator, and consequently reducing emissions to the atmosphere. For ANSP 306, the negotiated trajectories significantly increase system wide traffic throughput and efficiency. A Fleet Wide Trajectory Management System (FWTMS) 308 utilizing this method is built to manage trajectories for the entire fleet for an operator. The FWTMS 308 is a system consisting of a plurality of RTMS's 300 for individual aircraft in the operator's fleet. The system 308 can be integrated with other systems, such as the flight dispatch system, the flight performance engineering system, fuel planning systems, the aircrew management system, and the scheduling management system to improve the operator's operations to improve business bottom lines and customer satisfaction. FWTMS 308 may also be configured to execute using processor 301 or may be embodied in a separate processor (not shown in FIG. 3).

RTMS 300 embodies a method and system for managing the trajectory remotely for aerial vehicle 302 using, in the exemplary embodiment, ANSP 306 and OCC 304. ANSP 306 is the ground-based system and services that manage all air traffic in the airspace. The core of ANSP 306 is an automation system 310, which hosts a plurality of Air Traffic Management (ATM) 312 applications, air traffic controllers 314, and air traffic displays 316 used by air traffic controllers 314. ANSP 306 includes a Flight Plan Filing Interface 318 that receives flight plans 320 filed by OCC 304 through an OCC Flight Plan Filing Interface 322. ANSP 306 also includes an Air-Ground Data Link Manager 324 that supports a data link with aerial vehicle 302 and network communications with OCC 304. Voice communication 326 is also available for tactical communications between air traffic controllers 314 and a pilot 328 for a manned aerial vehicle 302. For an unmanned aerial vehicle 302, ground operation control personnel handle the voice communication via interface to the voice channel of unmanned aerial vehicle 302 while the voice communication remains transparent to air traffic controllers 314.

Aerial vehicle 302 may be manned, such as but not limited to a commercial jet airplane, or unmanned. Aerial vehicle 302 may include a Flight Management System (FMS) 330, which builds a trajectory for use by the aircraft's Automatic Flight Control System (AFCS) 332. There are a plurality of potential data link interfaces from the ground to the aircraft, including one from ANSP 306 (such as Aeronautical Telecommunication Network [ATN]/VHF Datalink Mode 2 [VDL-2]) 334 and another from an OCC data link interface 336, such as Aircraft Communications Addressing and Reporting System (ACARS).

OCC 304 is the facility that controls all aircraft for a given operator. OCC 304 may be ground-, sea-, air-, or space-based, depending on the specific situation. A novel aspect of OCC 304 is FWTMS 308. FWTMS 308 includes one or more RTMSs 300. In the exemplary embodiment, a single RTMS 300 generates a unique trajectory for each aerial vehicle 302 in the fleet. In various embodiments, a separate RTMS 300 is used for each aerial vehicle 302. In still other embodiments there may be multiple RTMSs 300, where each one generates the trajectory for multiple aerial vehicles 302. The implementation depends on processing speed needs and the interconnections between different systems at OCC 304, and the types of aircraft involved. RTMS 300 may include trajectory management functionalities similar to those of FMS 330 but without the memory and computational power limitations of an airborne FMS 330.

In various embodiments, FWTMS 308 is used for Trajectory Synchronization and Negotiation and OCC Flight Monitoring and Support.

The use of FWTMS 308 at OCC 304 for synchronization and negotiation of aerial vehicle 302 trajectory reduces the bandwidth and data communication costs to aerial vehicle 302, because the cost of communicating with aerial vehicle 302 over ACARS and/or ATN/VDL-2 are orders of magnitude larger than communications costs from OCC 304 to ANSP 306, which could simply be via a secure TCP/IP connection. With FWTMS 308, RTMS 300 for a specific aerial vehicle 302 may perform the trajectory synchronization and negotiation on behalf of the airborne FMS 330. RTMS 300 generates a continuous trajectory that is consistent with the airborne FMS (rather than simply a sequence of waypoints or airways that is generated by current flight planning systems), and easily accesses the latest weather forecast information. A state of aerial vehicle 302 (such as weight), including meteorological parameters (current winds and temperature) may be provided by surveillance data (such as Radar or Automatic Dependent Surveillance-Broadcast [ADS-B]) or measured by airborne sensors and downlinked to RTMS 300 automatically when needed without pilot intervention, such as the existing ACARS meteorological reports. The operator-ANSP network employs a network layer that is much cheaper to operate and less congested than the air-ground data link thus saves cost for ANSP 306 and the operator of aerial vehicle 302. Only the modifications needed by the airborne FMS are uplinked to aerial vehicle 302 for pilot 328 to review and accept. In a final uplink, updated FMS weather can be an integrated part of the uplinked data from OCC 304. The trajectory determined by RTMS 300 stays synchronized with the FMS trajectory throughout the duration of the flight to improve situation awareness at OCC 304. With this operational concept, an UAV is no longer distinguishable from manned aircraft from the trajectory point of view.

The OCC-based trajectory synchronization and negotiation, on the other hand, would not prevent direct air-ground exchange with ANSP 306 for short-term, tactical trajectory synchronization for conflict resolution or any other ATC actions which are time-critical.

In various other embodiments, FWTMS 308 is used for OCC Flight Monitoring and Support.

A major function of OCC 304 is to follow flights of a plurality of aerial vehicles 302 and provide flight information and technical support to the flights during their execution. In current operations, the flight monitoring system in OCC mainly utilizes tracking information provided by ANSP 306, such as FAA's Aircraft Situation Display to Industry (ASDI) system data. Some operators also include ACARS position reports downlinked by their flights in the flight monitoring system. However, FMS trajectories are often not accessible outside of aerial vehicle 302 or are expensive to communicate to the ground (to either OCC 304 or ANSP 306). This has resulted in poor predictions of the Estimated Time of Arrival (ETA), and thus has caused difficulties in planning ground operations at the destination airport. FWTMS 308 provides improved 4D trajectory prediction capability for an entire fleet being hosted at a single facility, provides data otherwise unavailable and/or reducing communication costs. A number of individual aerial vehicles 302 are assigned to an individual OCC controller (or dispatcher). The trajectory output may be shared with different systems at OCC 304 or different dispatcher positions, and the format of the trajectory may be formatted uniquely for each user. The OCC controller uses a graphical interface to monitor and interact with the operations of RTMS 300 as if a remote cockpit is provided to the OCC controller and provides a new means for the operator's OCC 304 to communicate with aircrew in case of an emergency, and thus greatly enhance operational efficiency and safety.

RTMS 300 and FWTMS 308 provide the aerial vehicle operator the same level of trajectory planning and prediction capability that previously was only available onboard aerial vehicle 302. Combined with direct knowledge of the aerial vehicle trajectory, and the capability of data link based trajectory synchronization and negotiation with ANSP 306, FWTMS 308 enables an operator to greatly improve their operations. This could result in significant fuel savings, flight delay reductions, reductions in missed equipment (e.g. aircraft) and crew connections, and consequently economic, social, and environmental benefits. FWTMS 308 is able to manage trajectories for UAVs as well, and serves as a means to integrate UAVs in civilian airspace.

Figure 4:
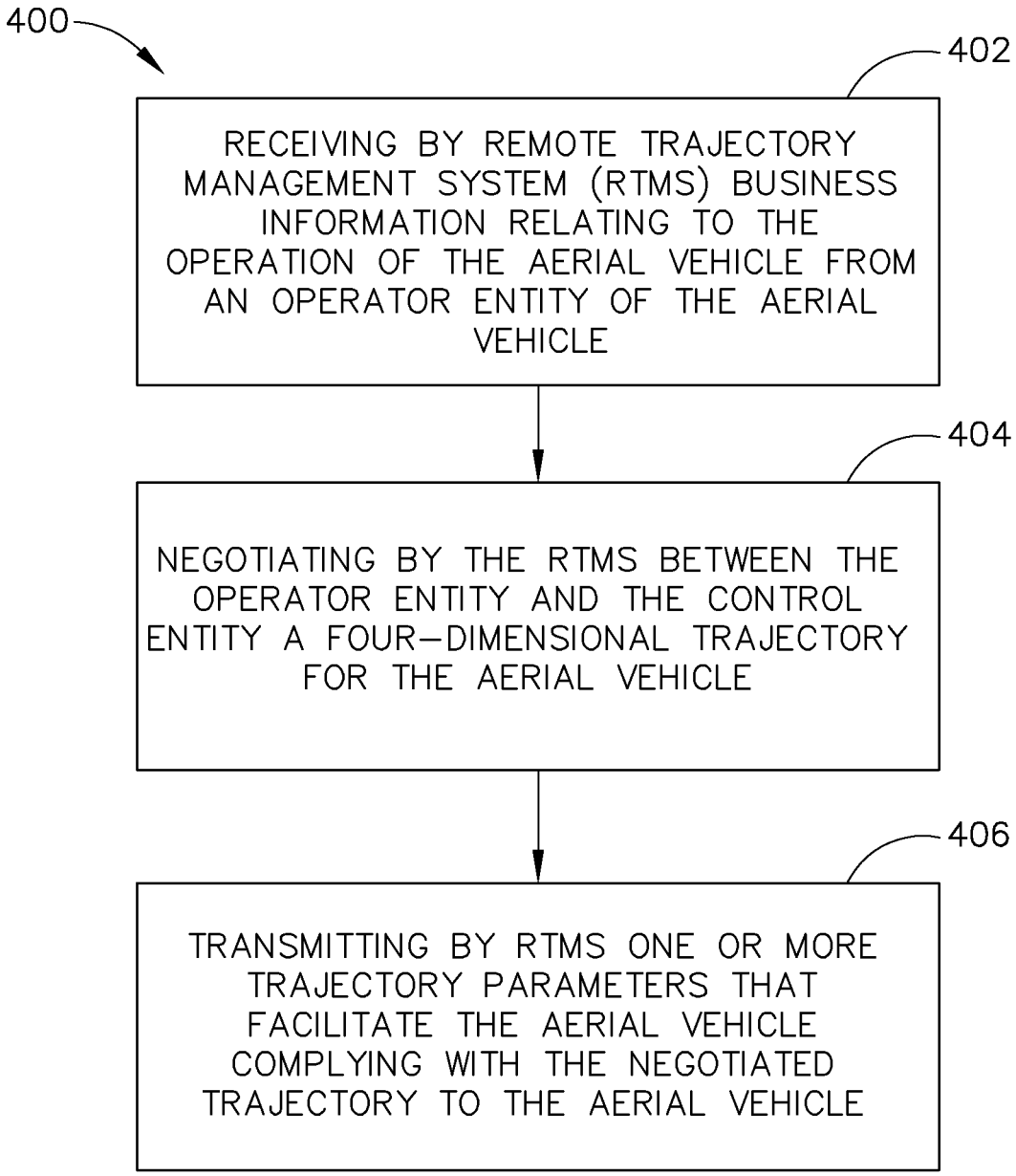
FIG. 4 is a flow diagram of a method 400 of managing an aerial vehicle trajectory in accordance with an exemplary embodiment of the present invention.

FIG. 4 is a flow diagram of a method 400 of managing an aerial vehicle trajectory. In the exemplary embodiment, method 400 includes receiving 402 by a remote trajectory management system (RTMS) business information relating to the operation of the aerial vehicle from an operator entity of the aerial vehicle, negotiating 404 by the RTMS between the operator entity and the control entity a four-dimensional trajectory for the aerial vehicle, and transmitting 406 by the RTMS one or more trajectory parameters that facilitate the aerial vehicle complying with the negotiated trajectory to the aerial vehicle.

The business information relating to the operation of the aerial vehicle can include flight planning information negotiated between the operator entity and an Air Navigation Service Provider (ANSP). The RTMS can also receive information relating to airspace constraints along a predetermined route of the aerial vehicle from an airspace control entity and weather information.

Method 400 also includes synchronizing the trajectory between the operator entity and the control entity wherein the trajectory may be a four-dimensional trajectory for the aerial vehicle. In various embodiments, the operator entity and the control entity synchronize the four-dimensional trajectory for the aerial vehicle by exchanging trajectory prediction and flight plan information. Exchanging trajectory prediction and flight plan information may also be a part of negotiating 404 by the RTMS between the operator entity and the control entity the 4D trajectory for the aerial vehicle.

Method 400 also includes receiving from the control entity flight plan modification data that in some embodiments includes receiving one or more waypoints, at least one of a two-dimensional position and a time, and at least one of a two-dimensional route change, an altitude change, a speed change, and a required-time-of-arrival (RTA). Method 400 also includes transmitting to the control entity a business preferred trajectory including at least one of an end-to-end two-dimensional route, a portion of a two-dimensional route, a cruise altitude, a departure procedure, an arrival procedure, and a preferred runway. The business preferred trajectory may be based on at least one of a RTMS predicted trajectory, and a RTMS predicted trajectory based on information obtained from the control entity. The one or more waypoints may include a three-dimensional position and a required time-of-arrival (RTA) at the three-dimensional position.

In an embodiment, method 400 includes receiving from the aerial vehicle a state of the aerial vehicle. The state may include at least one of a weight of the aerial vehicle, parameters measured by airborne sensors, and at least one of 3D and 4D position data, and meteorological parameters in a vicinity of the aerial vehicle. Method may also include transmitting to the aerial vehicle one or more waypoints to a flight management system (FMS) of the aerial vehicle.

The term processor, as used herein, refers to central processing units, microprocessors, microcontrollers, reduced instruction set circuits (RISC), application specific integrated circuits (ASIC), logic circuits, virtual machines, and any other circuit or processor capable of executing the functions described herein.

As used herein, the terms "software" and "firmware" are interchangeable, and include any computer program stored in memory for execution by processor 301, including RAM memory, ROM memory, EPROM memory, EEPROM memory, and non-volatile RAM (NVRAM) memory. The above memory types are exemplary only, and are thus not limiting as to the types of memory usable for storage of a computer program.

As will be appreciated based on the foregoing specification, the above-described embodiments of the disclosure may be implemented using computer programming or engineering techniques including computer software, firmware, hardware or any combination or subset thereof, wherein the technical effect is for providing 4D trajectory support for an aerial vehicle while maintaining a reduced computational load and communications burden on the aerial vehicle onboard systems. By receiving information from the aerial vehicle unavailable otherwise and transmitting only updates to the 4D trajectory carried onboard the aerial vehicle a robust, accurate, and timely 4D trajectory can be maintained. The system manages negotiations with regulatory bodies to generate the 4D trajectory that satisfies the aerial vehicle operator's business plan as well as efficient and safe throughput of a plurality of other aerial vehicles under the jurisdiction of the regulatory body. Any such resulting program, having computer-readable code means, may be embodied or provided within one or more computer-readable media, thereby making a computer program product, i.e., an article of manufacture, according to the discussed embodiments of the disclosure. The computer-readable media may be, for example, but is not limited to, a fixed (hard) drive, diskette, optical disk, magnetic tape, semiconductor memory such as read-only memory (ROM), and/or any transmitting/receiving medium such as the Internet or other communication network or link. The article of manufacture containing the computer code may be made and/or used by executing the code directly from one medium, by copying the code from one medium to another medium, or by transmitting the code over a network.

The above-described embodiments of a method and system of generating a 4D trajectory for an aerial vehicle provides a cost-effective and reliable means for sharing the trajectory and intent information of an aerial vehicle operator in a strategic manner, improving the ability to plan the flight and allocate appropriate resources to it. More specifically, the methods and systems described herein facilitate accurate generation of the trajectory and intent data, customizable trajectory output format, flexible input methods, and fast processing and dissemination of the relevant information. Additional advantages of the method and system described herein include improved collaboration and information sharing between aircraft operators and ANSPs, planning of flight trajectories for operators, which can reduce costs, and simple and inexpensive operation using for example, but not limited to, a stand alone personal computer. As a result, the methods and systems described herein facilitate automatically managing a 4D trajectory of an aerial vehicle in a cost-effective and reliable manner.

An exemplary method and system for automatically, or semi-automatically managing 4D trajectories for a single or a plurality of aerial vehicles are described above in detail. The system illustrated is not limited to the specific embodiments described herein, but rather, components of each may be utilized independently and separately from other components described herein. Each system component can also be used in combination with other system components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A remote trajectory management system (RTMS) for one or more aircraft comprising:

a processor communicatively coupled to a memory device configured to store computer executable instructions used by said processor to implement the RTMS, said memory device includes:

an input specification module configured to manage information specifying flight-specific input data used to generate a trajectory, wherein the input specification information includes an identifier associated with a particular aircraft;

an aircraft model module comprising data that specifies a performance of at least one of an aircraft alone and an airframe and engines of the aircraft;

a default input module comprising data that represents approximated default values for as yet unknown flight parameters used to generate a trajectory;

a consolidated inputs module configured to combine data from said input specification module and said default input module into a consistent data set, said consolidated inputs module further configured to perform a reasonableness check to determine that said consistent data set is within predetermined bounds based on reasonableness;

a predict 4D trajectory module configured to receive the specified inputs from said input specification module, an aircraft performance model, the aircraft model module, and the default input module and to generate a predicted 4D trajectory for a predetermined flight, wherein the predict 4D trajectory module processes the data from the aircraft model module such that the data represents the performance variations of the aircraft associated with the identifier; and a trajectory export module configured to transmit a predetermined subset of the predicted trajectory to the aircraft, where said RTMS is a ground-based system configured to optimize the predicted trajectory for each of a plurality of aerial vehicles operated by an operator entity, wherein such optimization generates a modified trajectory for each of the plurality of aerial vehicles based on business parameters provided by the operator entity and based on airspace restrictions and regulations provided by an air navigation service provider communicatively coupled to said RTMS, wherein the modified trajectories are generated exclusively by the ground-based RTMS.

2. A system in accordance with claim 1, wherein the input specification information includes at least one of an aircraft type model, a zero-fuel weight of the aircraft, an amount of fuel, a payload, a gross weight, a cruise altitude, a cost index, and a representation of a lateral route.

3. A system in accordance with claim 1, wherein said predict 4D trajectory module is configured to compute an air speed, a thrust, a drag, and a fuel-flow of the aircraft.

4. A system in accordance with claim 1, wherein said trajectory export module is configured to transmit the predetermined subset of the predicted trajectory to at least one of an air navigation service provider and to an entity in a control center of the aircraft operator.

5. A system in accordance with claim 1, wherein the RTMS is configured to manage a trajectory for a plurality of aircraft.

6. A method of managing an aerial vehicle trajectory, said method comprising:

receiving by a remote trajectory management system (RTMS) information relating to the operation of the aerial vehicle from an operator entity of the aerial vehicle, wherein a default input module comprising data that represents approximated default values for as yet unknown flight parameters used to generate a trajectory provides at least a portion of the information received by the RTMS, and wherein the information received by the RTMS includes an identifier associated with a particular aerial vehicle, wherein the RTMS is a ground-based system that includes a processor communicatively coupled to a memory device configured to store computer executable instructions used by processor to implement RTMS;

performing, using a consolidated inputs module, a reasonableness check on a consistent data set formed by combining data from said default input module and said operator entity, wherein said reasonableness check determines that said consistent data is within predetermined bounds based on reasonableness;

predicting, using the RTMS, a 4D trajectory of the aerial vehicle based on the received information, wherein the RTMS processes the received information such that the received information represents performance variations of the aerial vehicle associated with the identifier;

communicatively coupling the RTMS to an air navigation service provider, wherein the air navigation service provider is a control entity configured to manage air traffic in an airspace and configured to provide airspace restrictions and regulations to the RTMS;

optimizing, by the RTMS, the predicted trajectory of each of a plurality of aerial vehicles operated by the operator entity to generate a modified trajectory of each of the plurality of aerial vehicles based on business parameters provided by the operator entity and based on the airspace restrictions and regulations from the air navigation service provider;

transmitting to the aerial vehicle by the RTMS a predetermined subset of the predicted trajectory to facilitate the aerial vehicle complying with the modified trajectory.

7. A method in accordance with claim 6, further comprising receiving from the operator entity flight planning information negotiated between the operator entity and the Air Navigation Service Provider (ANSP).

8. A method in accordance with claim 6, further comprising receiving by the RTMS information relating to airspace constraints along a predetermined route of the aerial vehicle from an airspace control entity.

9. A method in accordance with claim 6, further comprising synchronizing the trajectory between the operator entity and the control entity.

10. A method in accordance with claim 9, wherein synchronizing by the RTMS between the operator entity and the control entity a four-dimensional trajectory for the aerial vehicle comprises exchanging trajectory prediction and flight plan information.

11. A method in accordance with claim 6, wherein optimizing, by the RTMS, the predicted trajectory of each of a plurality of aerial vehicles comprises exchanging trajectory prediction and flight plan information between the operator entity and the control entity.

12. A method in accordance with claim 6, further comprising receiving from the control entity flight plan modification data including at least one of one or more waypoints, at least one of a two-dimensional position and a time, and at least one of a two-dimensional route change, an altitude change, a speed change, and a required-time-of-arrival (RTA).

13. A method in accordance with claim 6, further comprising transmitting to the control entity a business preferred trajectory comprising at least one of an end-to-end two-dimensional route , a portion of a two-dimensional route, a cruise altitude, a departure procedure, an arrival procedure, and a preferred runway.

14. A method in accordance with claim 13, wherein transmitting to the control entity a business preferred trajectory comprises transmitting a business preferred trajectory is based on at least one of a RTMS predicted trajectory.

15. A method in accordance with claim 6, wherein transmitting to the aerial vehicle one or more waypoints comprises transmitting to the aerial vehicle a three-dimensional position and a required time-of-arrival (RTA) at the three-dimensional position.

16. A method in accordance with claim 6, further comprising receiving from the aerial vehicle a state of the aerial vehicle including at least one of a weight of the aerial vehicle, parameters measured by airborne sensors, and at least one of 3D and 4D position data.

17. A Fleet Wide Trajectory Management System (FWTMS) comprising:

a plurality of remote trajectory management systems (RTMS), each said RTMS comprising:

an input specification module configured to manage information specifying flight-specific input data used to generate a trajectory, wherein the input specification information includes an identifier associated with a particular aircraft;

an aircraft model module comprising data that specifies a performance of the aircraft and engines of the aircraft;

a default input module comprising data that represents approximated default values for as yet unknown flight parameters used to generate a trajectory;

a consolidated inputs module configured to combine data from said input specification module and said default input module into a consistent data set, said consolidated inputs module further configured to perform a reasonableness check to determine that said consistent data set is within predetermined bounds based on reasonableness;

a predict 4D trajectory module configured to receive the specified inputs from said input specification module and an aircraft performance model from aircraft model module and to generate a 4D trajectory for a predetermined flight, wherein the predict 4D trajectory module process the data from the aircraft model module such that the data represents the performance variations of the aircraft associated with the identifier; and a trajectory export module configured to transmit a predetermined subset of the predicted trajectory to the aircraft, where said FWTMS is a ground-based system configured to optimize the predicted trajectory for each of a plurality of aerial vehicles operated by an operator entity, wherein such optimization generates a separate and distinct modified trajectory for each of the plurality of aerial vehicles based on business parameters provided by the operator entity and based on airspace restrictions and regulations provided by an air navigation service provider communicatively coupled to said FWTMS, wherein the modified trajectories are generated exclusively by the ground-based FWTMS.

* * * * *